US008971003B2

(12) United States Patent
Furuta et al.

(10) Patent No.: US 8,971,003 B2
(45) Date of Patent: Mar. 3, 2015

(54) ELECTRONIC CONTROL DEVICE INCLUDING INTERRUPT WIRE

(75) Inventors: Takahiko Furuta, Kasugai (JP); Toru Itabashi, Anjo (JP); Yuuki Mikami, Kariya (JP); Hiroaki Nakamura, Nagaokakyo (JP); Shigeki Nishiyama, Nagaokakyo (JP)

(73) Assignees: DENSO CORPORATION, Kariya (JP); Murata Manufacturing Co., Ltd., Nagaokakyo-shi (JP)

( * ) Notice: Subject to any disclaimer, the term of this patent is extended or adjusted under 35 U.S.C. 154(b) by 331 days.

(21) Appl. No.: 13/362,295

(22) Filed: Jan. 31, 2012

(65) Prior Publication Data

US 2012/0201010 A1 Aug. 9, 2012

(30) Foreign Application Priority Data

Feb. 4, 2011 (JP) ..... 2011-22931

(51) Int. Cl.

| | |
|---|---|
| ***H01H 85/046*** | (2006.01) |
| ***H01H 85/02*** | (2006.01) |
| *H01H 85/041* | (2006.01) |
| *H01H 23/10* | (2006.01) |

(52) U.S. Cl.

CPC ..... *H01H 85/0241* (2013.01); *H01H 85/046* (2013.01); *H01H 2085/0414* (2013.01); *H01H 23/105* (2013.01); *H01H 23/10* (2013.01); *H01H 2085/0275* (2013.01)

USPC ..... 361/103; 361/104

(58) Field of Classification Search

CPC ..... H01H 2085/0414; H01H 23/5256; H01H 23/62; H01H 85/046; H01H 23/10; H01H 23/105

USPC ..... 361/103, 104

See application file for complete search history.

(56) References Cited

U.S. PATENT DOCUMENTS

| | | | | |
|---|---|---|---|---|
| 5,355,274 | A * | 10/1994 | Marach et al. | 361/104 |
| 5,541,489 | A * | 7/1996 | Dunstan | 320/134 |
| 6,450,587 | B1 * | 9/2002 | MacGregor et al. | 303/89 |
| 7,211,907 | B2 * | 5/2007 | Kephart | 307/10.7 |
| 7,336,497 | B2 * | 2/2008 | Eusterholz et al. | 361/725 |

(Continued)

FOREIGN PATENT DOCUMENTS

| | | |
|---|---|---|
| JP | U-52-168254 | 12/1977 |
| JP | U-54-159163 | 11/1979 |

(Continued)

OTHER PUBLICATIONS

Web document: Fuse Selection Guide, Jan. 2010, N/A, pp. 1/9-9/9. www.optifuse.com/PDFs/FuseSelectionGuide_RevA.pdf.*

(Continued)

*Primary Examiner* — Zeev V Kitov

(74) *Attorney, Agent, or Firm* — Posz Law Group, PLC

(57) ABSTRACT

An electronic control device includes one or more substrates, a casing, a plurality of circuit blocks, a common wire, a plurality of branch wires and two interrupt wires. The circuit blocks are disposed on the substrates and the substrates are disposed in the casing. The common wire is shared by the circuit blocks. The branch wires are respectively coupled between the circuit blocks and the common wire. The two interrupt wires are respectively coupled with two of the common wire and the branch wires for overcurrent protection of the circuit blocks.

19 Claims, 11 Drawing Sheets

(56) References Cited

U.S. PATENT DOCUMENTS

| | | | | |
|---|---|---|---|---|
| 7,385,475 | B2 * | 6/2008 | Bender et al. | 337/297 |
| 7,732,898 | B2 * | 6/2010 | Barth | 257/665 |
| 8,125,343 | B2 * | 2/2012 | Denale | 340/573.1 |
| 8,385,240 | B2 * | 2/2013 | Krishnaswamy | 370/311 |
| 2003/0048620 | A1 | 3/2003 | Nishimura et al. | |
| 2004/0184211 | A1 | 9/2004 | Bender et al. | |
| 2006/0192663 | A1 * | 8/2006 | Bryan et al. | 340/457.1 |
| 2008/0239684 | A1 | 10/2008 | Yamasaki | |
| 2009/0187314 | A1 | 7/2009 | Kitamura et al. | |
| 2012/0200970 | A1 | 8/2012 | Itabashi et al. | |
| 2012/0200972 | A1 | 8/2012 | Furuta et al. | |
| 2012/0200973 | A1 | 8/2012 | Shiraishi et al. | |
| 2012/0200974 | A1 | 8/2012 | Mikami et al. | |

FOREIGN PATENT DOCUMENTS

| | | | |
|---|---|---|---|
| JP | U-54-177551 | | 12/1979 |
| JP | 55-14731 | | 1/1980 |
| JP | U-55-14730 | | 1/1980 |
| JP | U-55-108776 | | 7/1980 |
| JP | S62-107341 | U | 7/1987 |
| JP | S64-013650 | U | 1/1989 |
| JP | A-2000-003662 | | 1/2000 |
| JP | A-2000-164992 | | 6/2000 |
| JP | 2001-307617 | A | 11/2001 |
| JP | A-2003-019933 | | 1/2003 |
| JP | A-2004-158377 | | 6/2004 |
| JP | A-2006-114606 | | 4/2006 |
| JP | 2007095592 | A | 4/2007 |
| JP | 2007-311467 | A | 11/2007 |
| JP | A-2008-060381 | | 3/2008 |

OTHER PUBLICATIONS

Office Action mailed Nov. 19, 2013 in the corresponding JP application No. 2013-001731, which is the Divisional Application of JP No. 2011-022927.

Office Action mailed Nov. 13, 2012 in corresponding JP Application No. 2011-022924 (and English translation).

Office Action mailed Nov. 13, 2012 in corresponding JP Application No. 2011-022931 (and English translation).

Office Action mailed Nov. 13, 2012 in corresponding JP Application No. 2011-022927 (and English translation).

Office Action mailed Nov. 13, 2012 in corresponding JP Application No. 2011-022928 (and English translation).

Office Action mailed Nov. 13, 2012 in corresponding JP Application No. 2011-022930 (and English translation).

Office Action mailed Nov. 13, 2012 in corresponding JP Application No. 2011-022929 (and English translation).

Office Action mailed Nov. 13, 2012 in corresponding JP Application No. 2011-022926 (and English translation).

Office Action mailed Nov. 13, 2012 in corresponding JP Application No. 2011-022925 (and English translation).

Office Action mailed Jul. 2, 2013 issued in corresponding JP patent application No. 2011-022929 (and English translation).

Office Action mailed Jul. 2, 2013 issued in corresponding JP patent application No. 2011-022925 (and English translation).

Office Action mailed Jul. 2, 2013 issued in corresponding JP patent application No. 2011-022931 (and English translation).

Office Action mailed Jul. 23, 2013 in the corresponding JP application No. 2013-002744, which is Division Application of JP No. 2011-022928 (English translation).

Office Action mailed Sep. 17, 2013 in corresponding JP Application No. 2013-002745 (and English translation).

Search/Examination Report mailed on Mar. 7, 2014 in corresponding CN application No. 2012 1002 5343.4 (English Translation).

Second Office Action dated Oct. 8, 2014 issued in corresponding CN patent application No. 201210025343.4 (and English translation).

* cited by examiner

ELECTRONIC CONTROL DEVICE INCLUDING INTERRUPT WIRE

CROSS REFERENCE TO RELATED APPLICATIONS

The present application is based on and claims priority to Japanese Patent Application No. 2011-22931 filed on Feb. 4, 2011, the disclosure of which is incorporated herein by reference.

TECHNICAL FIELD

The present invention relates to an electronic control device including an interrupt wire for overcurrent protection.

BACKGROUND

Conventionally, an electronic control device includes a fuse in case of a fault in the electronic control device. In an electronic control device in which small components are densely arranged, because a short-circuit current generated at a short-circuit fault in the small components does not reach a high current, it takes a long time to interrupt by the fuse. Especially when a large fuse is used for protecting a plurality of electronic control devices so as to reduce the number of fuses and a cost, it takes a longer time. Thus, temperatures of the components may be increased at an interruption and a voltage drop in a power supply wire and the like may be caused for a long time. In contrast, in a common wire, such as a power supply wire (e.g., a battery path and a ground path), that supplies electric power required for operating many circuits and many components mounted in accordance with advancement and diversification of electronic control, a relatively high current flows. Thus, an interrupting current of a large fuse disposed in a common wire path is further increased, and the electronic control device does not secure a sufficient interrupt performance at a short-circuit fault in each circuit or each component. The above-described issue becomes noticeable, for example, in an electronic control device for a vehicle used at a higher temperature and including many mounted devices.

JP-A-2007-311467 discloses a printed circuit board control device in which an interrupt wire is disposed in a power supply wire in each substrate. If an overcurrent flows, the interrupt wire melts and the power supply wire is interrupted in each substrate or each device.

In some cases, a plurality of circuit blocks is disposed on the substrate so that the circuit blocks perform different functions. When a short-circuit fault and the like occurs in one of the circuit blocks, an overcurrent may be generated in the short-circuited circuit block and a voltage drop may occur in other circuit blocks due to the overcurrent. The voltage drop may adversely affect operations of other circuit blocks, as disclosed in JP-A-2007-311467. Thus, the interrupt wire is disposed on the substrate for overcurrent protection. However, when the interrupt wire melts for any reason, entire circuit blocks coupled with the interrupt wire stop operations.

SUMMARY

In view of the foregoing problems, it is an object of the present invention to provide an electronic control device, which can protect a plurality of circuit blocks with interrupt wires.

An electronic control device according to an aspect of the present invention includes one or more substrates, a casing, a plurality of circuit blocks, a common wire, a plurality of branch wires and two interrupt wires. The circuit blocks are disposed on the substrates and the substrates are disposed in the casing. The common wire is shared by the circuit blocks. The branch wires are respectively coupled between the circuit blocks and the common wire. The two interrupt wires are respectively coupled with two of the common wire and the branch wires for overcurrent protection of the circuit blocks.

In the above electronic control device, when one of the interrupt wires is coupled with one of the branch wires and melts by heat generated by overcurrent, the corresponding circuit block is interrupted and stops operation. However, other circuit blocks except the circuit block interrupted by the one of the interrupt wires continue operation. Thus, the plurality of circuit blocks can be protected by the interrupt wires.

BRIEF DESCRIPTION OF THE DRAWINGS

Additional objects and advantages of the present invention will be more readily apparent from the following detailed description when taken together with the accompanying drawings. In the drawings.

DETAILED DESCRIPTION (First Embodiment)

An electronic control device 20 according to a first embodiment of the present disclosure will be described with reference to drawings.

Figure 1:
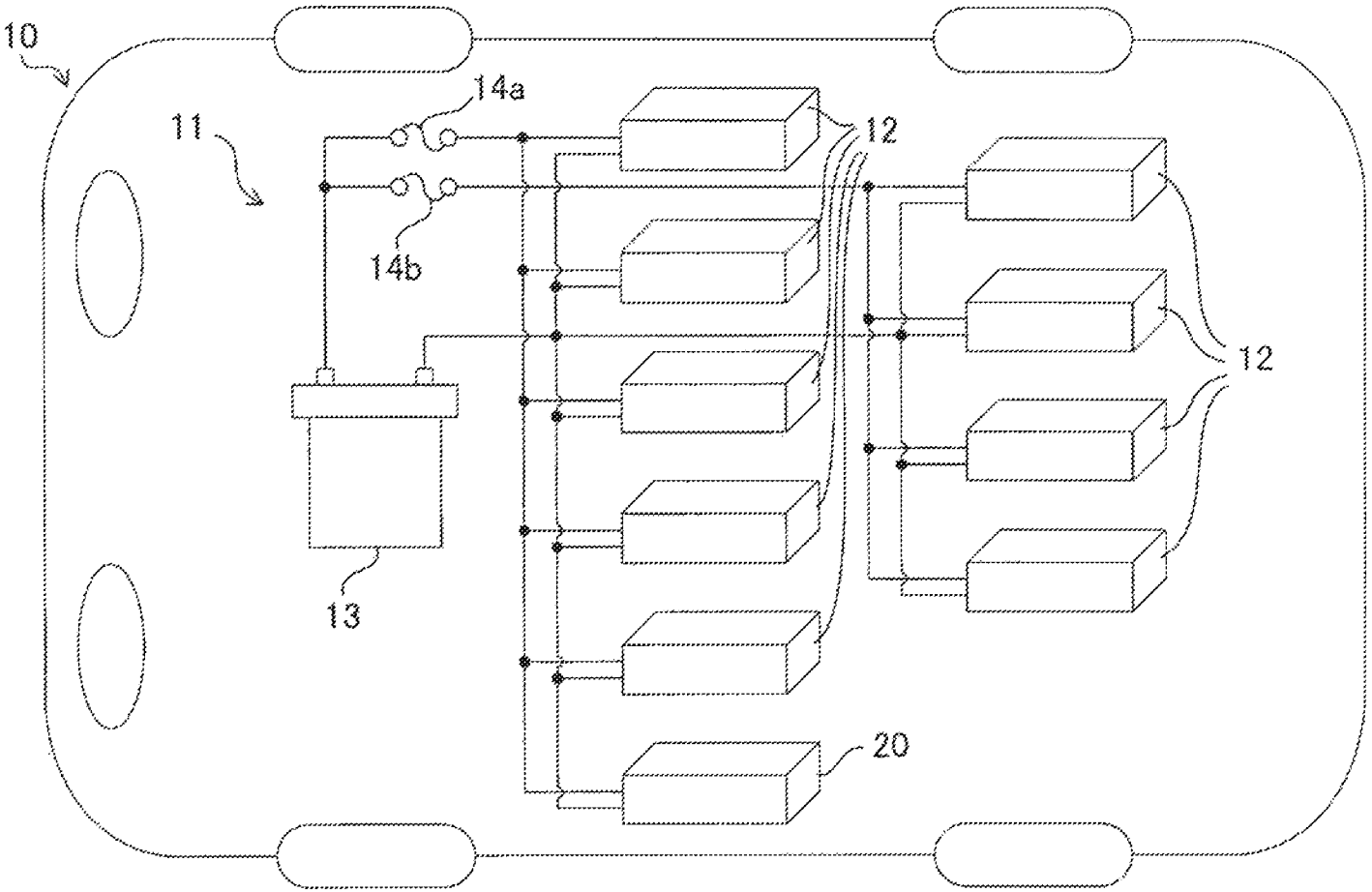
FIG. 1 is a block diagram showing a vehicle control system including an electronic control device according to a first embodiment of the present disclosure.

As shown in FIG. 1, a vehicle control system 11 includes a plurality of electronic control devices 12, such as an engine electronic control unit (ECU), a brake ECU, a steering ECU, a body ECU and a navigation device, which are mounted on a vehicle 10.

The electronic control device 20 according to the present embodiment can be suitably used as an electronic control device 12 included in the vehicle control system 11. The electronic control device 20 performs multiple functions including a less important function and a more important function. Specifically, as the less important function, the electronic control device 20 restricts an acceleration slip of a driving wheel, and as the more important function, the electronic control device 20 controls an engine as the engine ECU and controls a brake as the brake ECU. The electronic control device 20 may also control other vehicle-mounted devices. The controls of other vehicle-mounted devices include a less important control, such as a control regarding to a communication function, and a more important control.

The electronic control devices 12 including the electronic control device 20 according to the present embodiment are electrically coupled with a battery 13 via one of fuses 14*a*, 14*b* used for overcurrent protection. The battery 13 is a direct-current power source. Because each of the fuses 14*a*, 14*b* is disposed on a power supply path for supplying electric power to many electronic control devices, each of the fuses 14*a*, 14*b* may be a large fuse for 15 A or 20 A. When one of the electronic control devices 12 coupled with the fuse 14*a* has abnormality and an overcurrent greater than a predetermined current value is generated, the fuse 14*a* blows out by the overcurrent, and a power supply via the fuse 14*a* is interrupted. Thus, an adverse influence to the other electronic control devices 12 can be restricted. In an example shown in FIG. 1, each of the electronic control devices 12 is electrically coupled with the battery 13 via one of the fuses 14*a*, 14*b*. However, all the electronic control devices 12 may also be electrically coupled with the battery 13 via a single fuse, or each of the electronic control devices 12 may also be electrically coupled with the battery 13 via one of more than two fuses.

Figure 2:
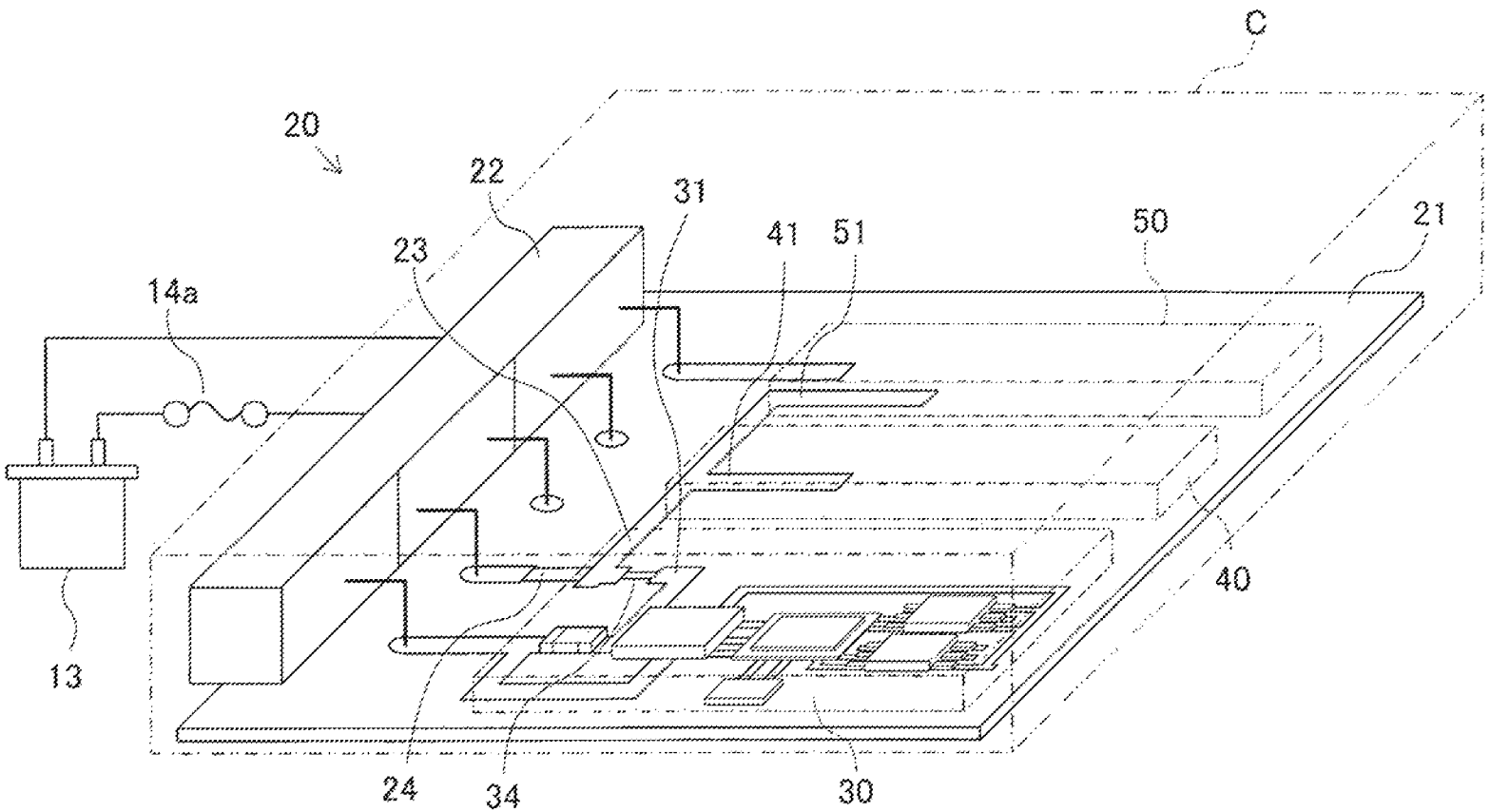
FIG. 2 is a diagram showing the electronic control device according to the first embodiment.
Figure 3:
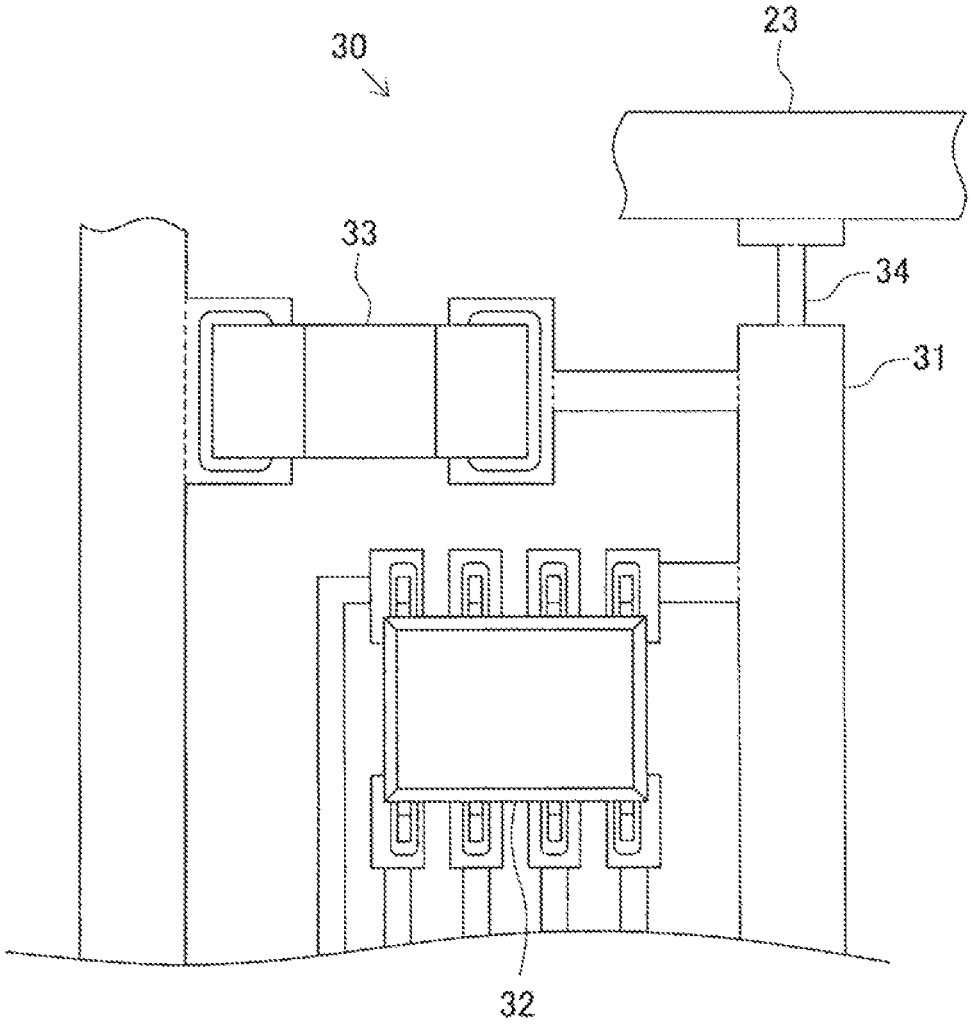
FIG. 3 is a diagram showing a part of the electronic control device shown in FIG. 2.

A configuration of the electronic control device 20 according to the present embodiment will be described with reference to FIG. 2 and FIG. 3. In FIG. 2, circuit blocks 40 and 50 are shown by two-dot chain lines for convenience of drawing.

The electronic control device 20 includes a casing C, a circuit substrate 21 and circuit blocks 30, 40, 50. The circuit blocks 30, 40, 50 are disposed on the circuit substrate 21, and the circuit substrate 21 is disposed in the casing C. The circuit block 30 restricts the acceleration slip of the driving wheel, the circuit block 40 controls the engine as the engine ECU, and the circuit block 50 controls the brake as the brake ECU. The circuit substrate 21 is electrically coupled with external devices and other electronic control devices 12 via a connector 22. Each of the circuit blocks 30, 40, 50 performs a corresponding function according to a predetermined signal transmitted from outside.

As shown in FIG. 2, the circuit blocks 30, 40, 50 are electrically coupled with a power supply wire 23 via branch wires 31, 41, 51, respectively. The power supply wire 23 supplies electric power of the battery 13 to the circuit blocks 30, 40, 50 via the connector 22. Thus, the power supply wire 23 can function as a common wire shared by the circuit blocks 30, 40, 50.

In the power supply wire 23, an interrupt wire 24 that functions as overcurrent protection for the circuit substrate 21, which includes the circuit blocks 30, 40, 50, is disposed. The interrupt wire 24 melts by heat generated by an overcurrent and interrupts an electric connection via the interrupt wire 24. The interrupt wire 24 has a wire width sufficiently smaller than a wire width of the power supply wire 23. The wire width means a dimension in a direction that is perpendicular to a direction of electric current on a surface of the circuit substrate 21. For example, the interrupt wire 24 has a wire width within a range from 0.2 mm to 0.3 mm, and the power supply wire 23 has a wire width of 2 mm. The interrupt wire 24 functions as a first interrupt wire.

A configuration of the circuit block 30 will be described with reference to FIG. 3. In the circuit block 30, a plurality of electronic components 32 for restricting the acceleration slip is densely-mounted on the circuit substrate 21. One of the electronic components 32 on the circuit substrate 21 is a ceramic capacitor 33. The ceramic capacitor 33 may be formed by stacking a high-permittivity ceramic made of barium titanate and an internal electrode in layers for improving temperature characteristics and frequency characteristics, and thereby having a large capacity with a small size.

The circuit block 30 is coupled with the power supply wire 23 via the branch wire 31. In the branch wire 31, an interrupt wire 34 that functions as overcurrent protection for the circuit block 30 is disposed. The interrupt wire 34 melts by heat generated by an overcurrent and interrupts an electric connection via the interrupt wire 34. The interrupt wire 34 has a wire width smaller than the wire width of the interrupt wire 24 so that an interrupting current of the interrupt wire 34 is smaller than an interrupting current of the interrupt wire 24. The interrupt wire 34 functions as a second interrupt wire.

In the electronic control device 20 having the above-described configuration, for example, when a short-circuit fault occurs in the ceramic capacitor 33 and an overcurrent flows in the interrupt wire 34, the interrupt wire 34 generates heat in accordance with the overcurrent. When the generated heat becomes greater than a predetermined temperature, the interrupt wire 34 melts, and the electric connection via the interrupt wire 34 is interrupted. Accordingly, the other circuit blocks 40 and 50 coupled with the power supply wire 23 can be protected from the overcurrent. The current at interruption is not high enough to blow the interrupt wire 24 and the fuse 14*a*. Thus, the damage of the circuit block 30 does not influence to the other circuit blocks 40 and 50 supplied with power via the interrupt wire 24 and other electronic control devices 12 supplied with power via the fuse 14*a*. A time from generation of the overcurrent to the melting of the interrupt wire 34 is a few milliseconds, and a melting time of each of the fuses 14*a*, 14*b* is generally about 0.02 seconds. Thus, the overcurrent protection can be appropriately achieved even to an electronic control device or an electronic component that is required to improve a processing speed.

Each of the circuit blocks 40 and 50 does not include the interrupt wire 34. When a short-circuit fault and the like occurs in the circuit block 40 or 50, an overcurrent generates and flows to the power supply wire 23. Then the interrupt wire 24 melts by heat generated by the overcurrent. Thus, the circuit blocks 30, 40, 50 stop operation. In a case where the interrupt wire 24 is not disposed, the overcurrent in the power supply wire 23 causes a voltage drop in the power supply wire 23, and the voltage drop may cause false operations of the circuit blocks coupled with the power supply wire 23. Therefore, when the interrupt wire 24 is disposed, false operations in other circuit blocks except the circuit block in which the short-circuit fault occurs are restricted. Accordingly, a plurality of circuit blocks 30, 40, 50 disposed on the circuit substrate 21 is protected by the interrupt wires 24 and 34.

Specifically, because the interrupting current of the interrupt wire 34 is smaller than the interrupting current of the interrupt wire 24, when a short-circuit fault and the like occurs in the circuit block 30, the interrupt wire 34 melts earlier than the interrupt wire 24 by an overcurrent generated in the circuit block 30. By this way, adverse effects to other circuit blocks 40 and 50 are restricted with certainty.

Figure 4:
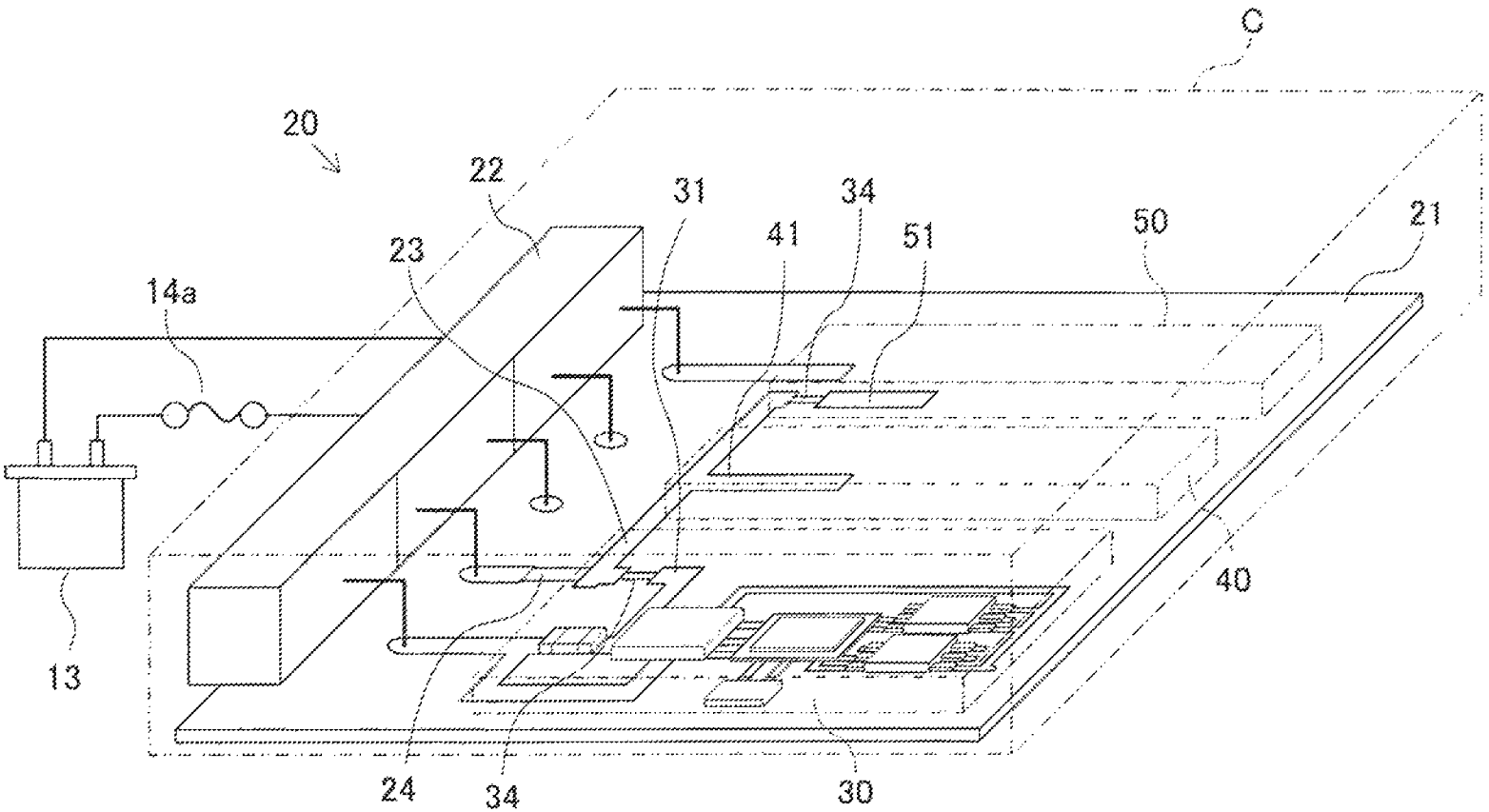
FIG. 4 is a diagram showing an electronic control device according to a first modification of the first embodiment.

An electronic control device 20 according to a first modification of the first embodiment will be described with reference to FIG. 4. In the electronic control device 20 according to the first modification of the first embodiment, an interrupt wire 34 may also be disposed in the circuit block 40 or 50 in addition to the interrupt wire 34 disposed in the circuit block 30. For example, as shown in FIG. 4, the interrupt wire 34 may be disposed in the branch wire 51 of the circuit block 50. In this case, an interrupting condition of the interrupt wire may be adjusted according to an importance of the function of the corresponding circuit block.

Figure 5:
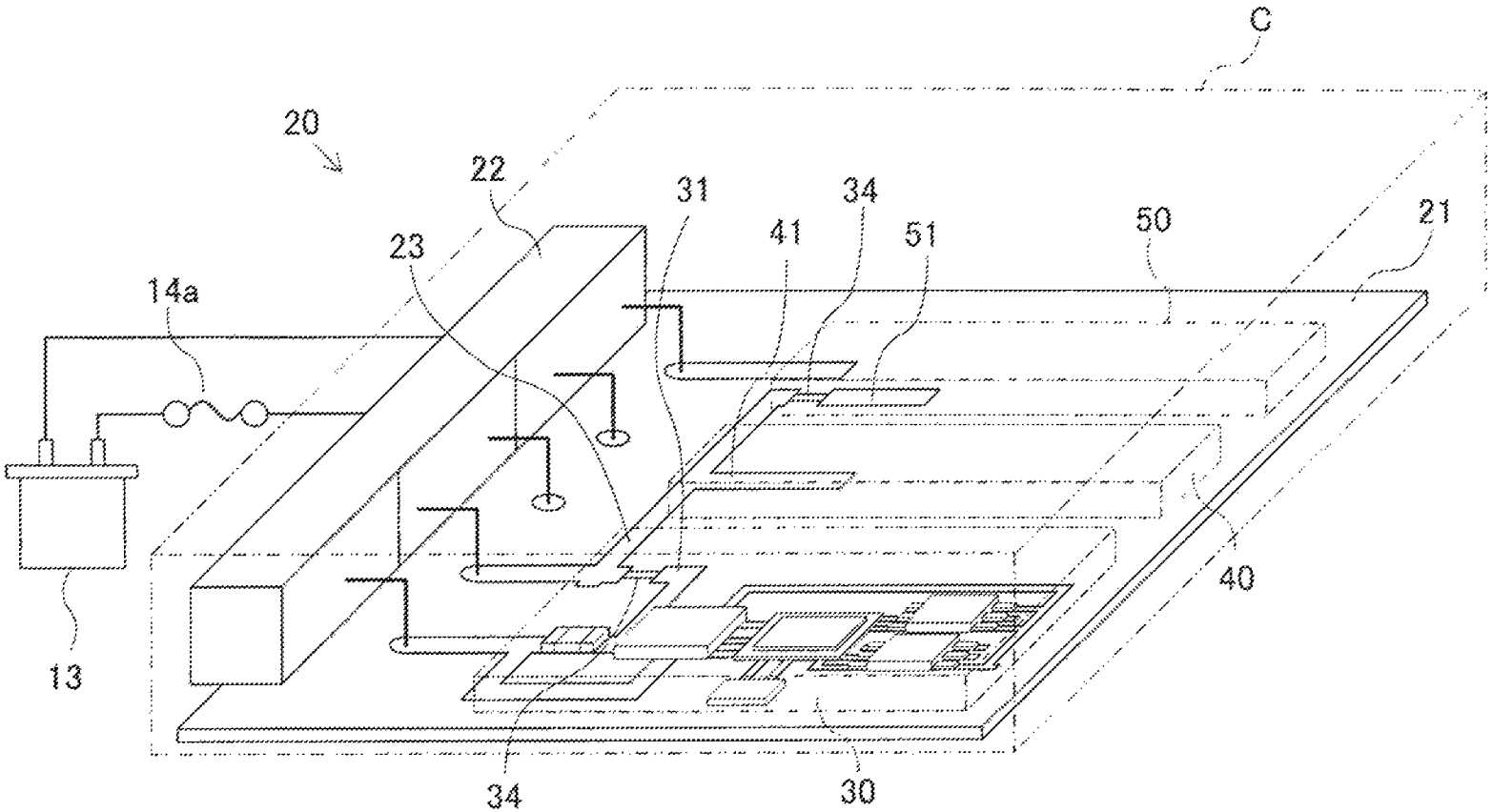
FIG. 5 is a diagram showing an electronic control device according to a second modification of the first embodiment.

An electronic control 20 device according to a second modification of the first embodiment will be described with reference to FIG. 5. In the electronic control device 20, at least two of the circuit blocks 30, 40, 50 may include respective interrupt wires 34. For example, as shown in FIG. 5, two interrupt wires 34 are disposed in the respective circuit blocks 30 and 50 without disposing the interrupt wire 24.

In a case where two interrupt wires 34 are disposed in two respective circuit blocks performing different functions including a more important function and a less important function, the interrupt wire 34 disposed in the circuit block performing a less important function may be configured to have a smaller interrupting current than the interrupt wire 34 disposed in the circuit block performing a more important function.

By the above-described configuration, the interrupt wire 34 disposed in the circuit block performing the less important function, such as the restriction of the acceleration slip of the driving wheel, has smaller interrupting current than the interrupting current of the interrupt wire 34 disposed in the circuit block performing the more important function, such as control of the brake. Thus, the interrupt wire 34 disposed in the circuit block performing the less important function melts earlier than the interrupt wire 34 disposed in the circuit block performing the more important function. As described above, the interrupt wires 34 is disposed according to the importance of the function of the circuit block so that the circuit block performing the more important function continues operation even when the circuit block performing the less important function stops operation. The interrupt wire 34 disposed in the circuit block performing the less important function corresponds to the second interrupt wire, and the interrupt wire 34 disposed in the circuit block performing the more important function functions as a third interrupt wire.

Figure 6:
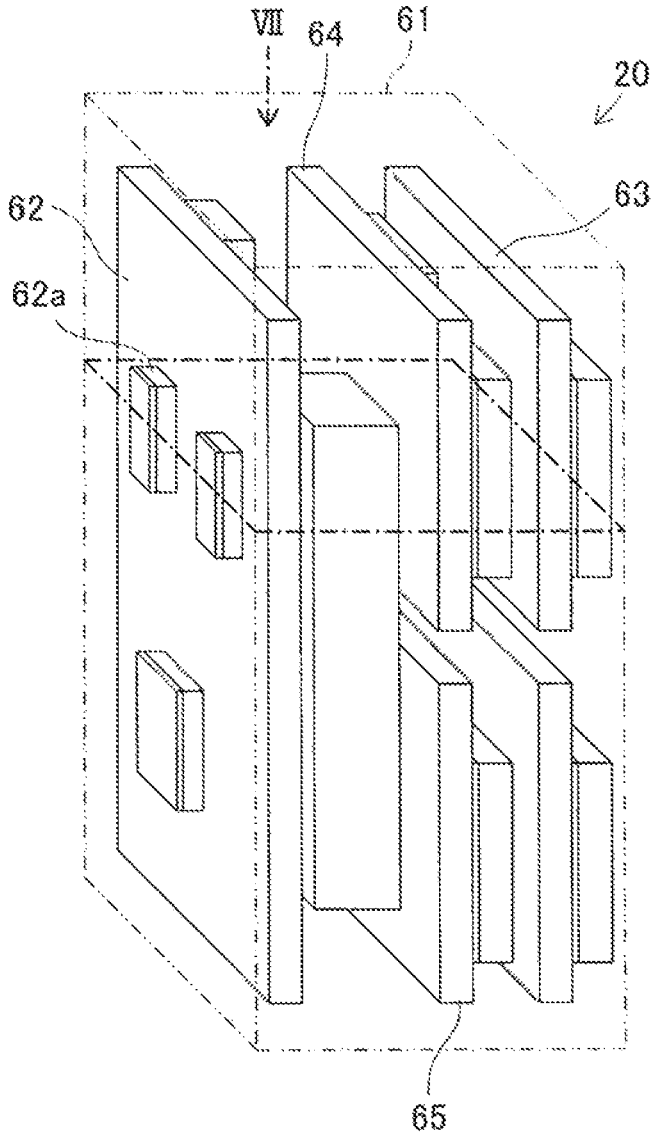
FIG. 6 is a diagram showing an electronic control device according to a third modification of the first embodiment.
Figure 7:
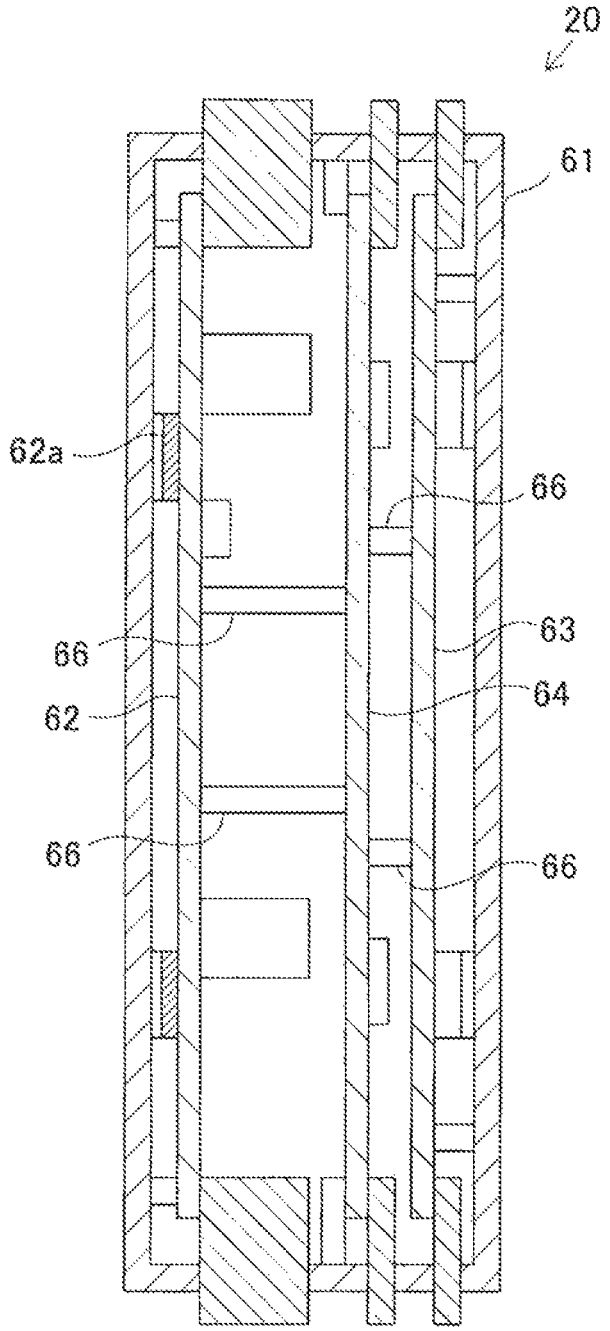
FIG. 7 is a diagram showing the electronic control device viewed from a direction XII in FIG. 6.
Figure 8:
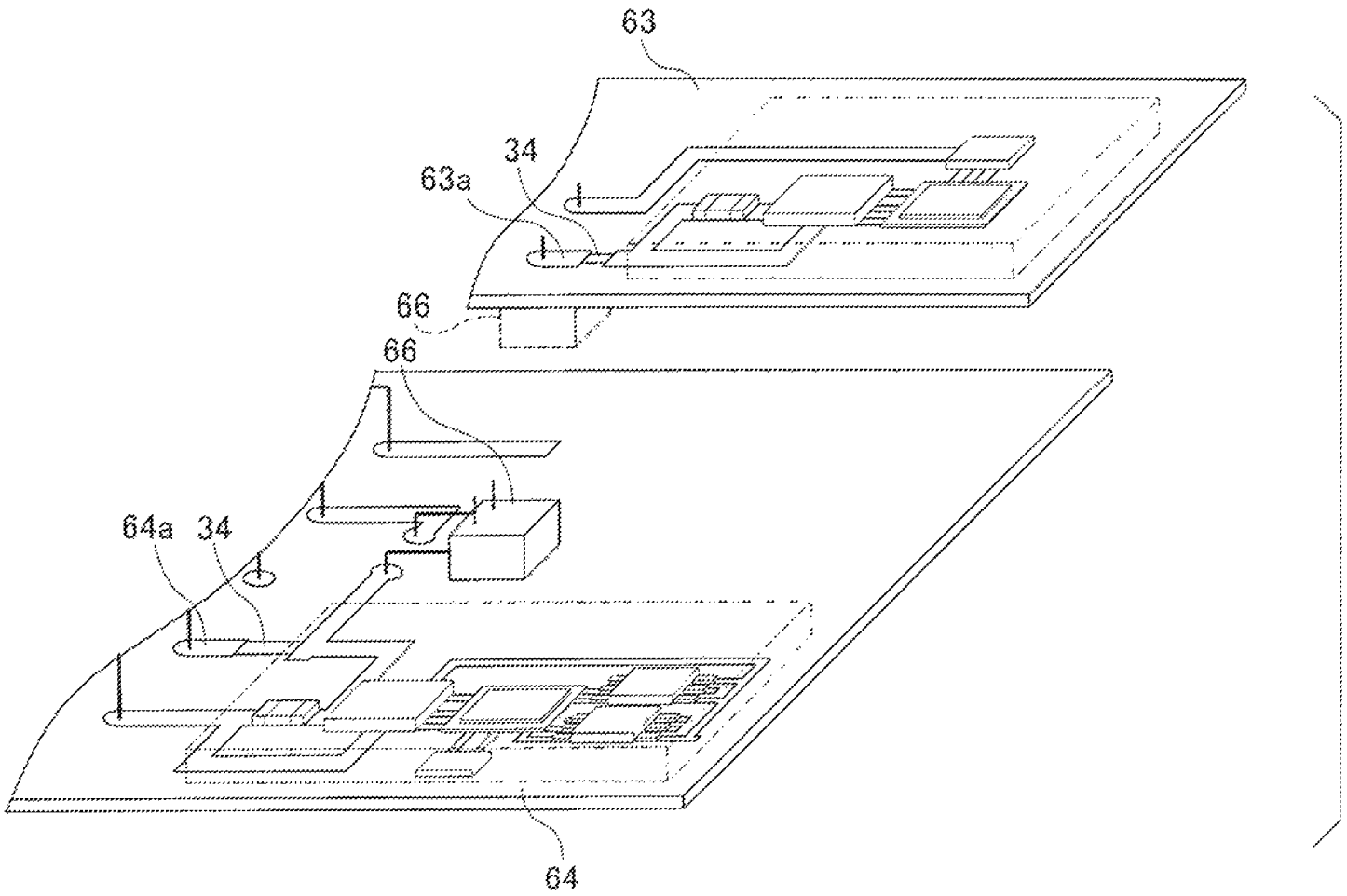
FIG. 8 is a diagram showing a module circuit substrate of the electronic control device according to the third modification of the first embodiment.

An electronic control device 20 according to a third modification of the first embodiment will be described with reference to FIG. 6 to FIG. 8. In FIG. 6, a configuration in a casing 61 of the electronic control device 20 is shown. In FIG. 6, some connectors are omitted for convenience of drawing.

In the electronic control device 20 according to the third modification of the first embodiment, a plurality of circuit blocks may be disposed on a circuit substrate or on a plurality of circuit substrates. For example, as shown in FIG. 6 and FIG. 7, the circuit blocks 30, 40, 50 are disposed on circuit substrates that are electrically coupled with each other, and the circuit substrates are disposed in the casing 61. Specifically, a power supply circuit 62*a* including common electronic components are mounted on a mother substrate 62. A common electronic component means an electronic component that is shared by the circuit blocks 30, 40, 50. The mother substrate 62 is electrically coupled with module substrates 63, 64, 65 that respectively perform the functions of the circuit blocks 30, 40, 50 via connectors 66. Each of the connectors 66 is disposed between two adjacent substrates 63, 64, 65.

In this case, the power supply wire 23, which is the common wire, may be disposed on the mother substrate 62, and branch wires may be disposed on respective module substrates and coupled with the power supply wire 23 via the connectors 66. Additionally, the interrupt wire 24 may be disposed in the power supply wire 23 on the mother substrate 62, and at least one of the branch wires may include the interrupt wire 34. For example, as shown in FIG. 8, interrupt wires 34 may be disposed in the branch wire 63*a* of the module substrate 63 and in the branch wire 64*a* of the module substrate 64. By the above-described configuration, circuit blocks disposed on the module substrates 63-65 and the mother substrate 62 can be protected by the interrupt wires 24 and 34.

Further, at least one of the module substrates may include a plurality of circuit blocks as the above-described circuit substrate 21. On the module substrate, the interrupt wire 34 may be disposed at least in one of the branch wires of the circuit blocks.

(Second Embodiment)

Figure 9:
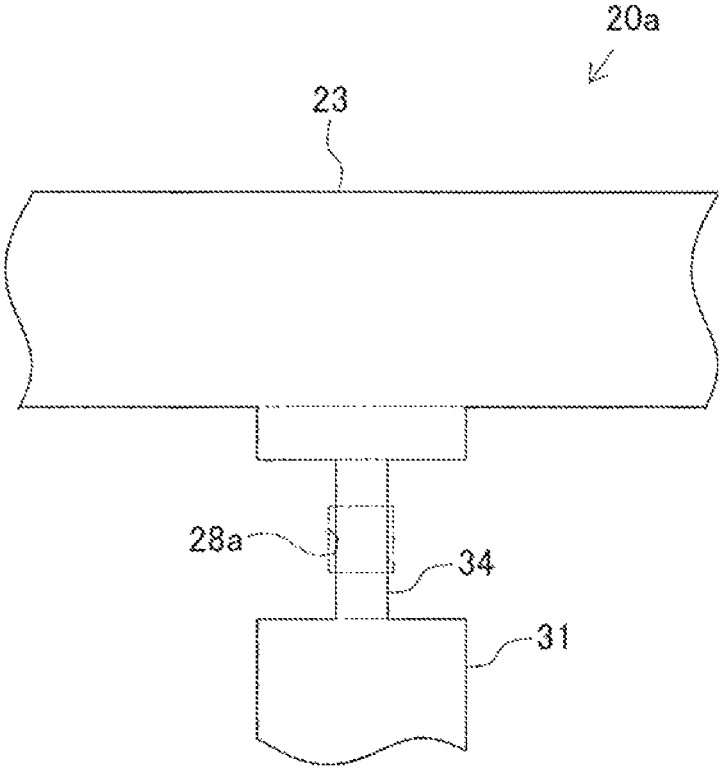
FIG. 9 is a diagram showing a part of an electronic control device according to a second embodiment of the present disclosure.

An electronic control device 20*a* according to a second embodiment of the present disclosure will be described with reference to FIG. 9. In FIG. 9, a solder resist layer that defines an opening portion 28*a* is not shown for convenience.

In the electronic control device 20*a*, the solder resist layer, which functions as a protective layer protecting a surface of the circuit substrate, defines the opening portion 28*a* so that at least a portion of the interrupt wire 34 is exposed outside.

As shown in FIG. 9, the solder resist layer defines the opening portion 28*a* in such a manner that a middle portion of an entire length of the interrupt wire 34, which is most likely to generate heat, is exposed outside.

Reasons of providing the opening portion 28*a* will be described with reference to FIG. 10 and FIG. 11.

Figure 10:
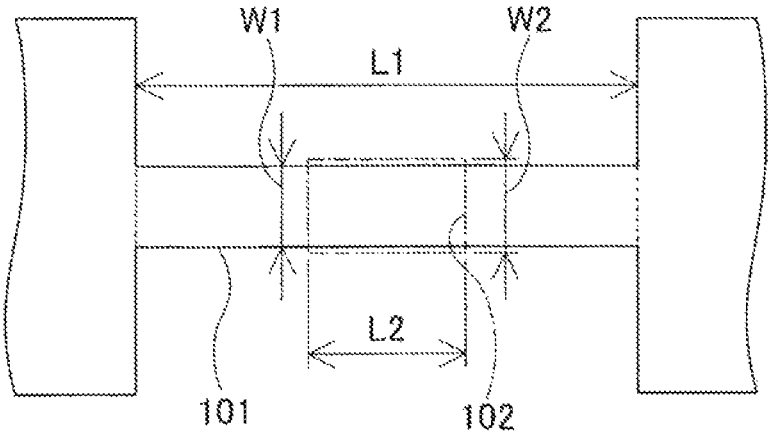
FIG. 10 is a diagram showing a device including a test interrupt wire and a test opening portion.

In a device shown in FIG. 10, a portion of a test interrupt wire 101 is exposed outside through a test opening portion 102 defined by a solder resist layer. The test interrupt wire 101 is supplied with a predetermined current, and an interrupting current I with which the test interrupt wire 101 melts and a melting time t when the test interrupt wire 101 melts are measured. Furthermore, an interrupting current I and a melting time t of a test interrupt wire 101 in a case where a solder resist layer does not define a test opening portion 102 are also measured. The test interrupt wire 101 has an entire length L1 of 2.85 mm and has a width W1 of 0.25 mm. The test opening portion 102 has an opening length L2 of 0.6 mm in a direction parallel to a length direction of the test interrupt wire 101 and has an opening width W2 of 0.25 mm in a width direction of the test interrupt wire 101. In FIG. 10, the opening width W2 is drawn as being longer than the width W1 for convenience of drawing.

Figure 11:
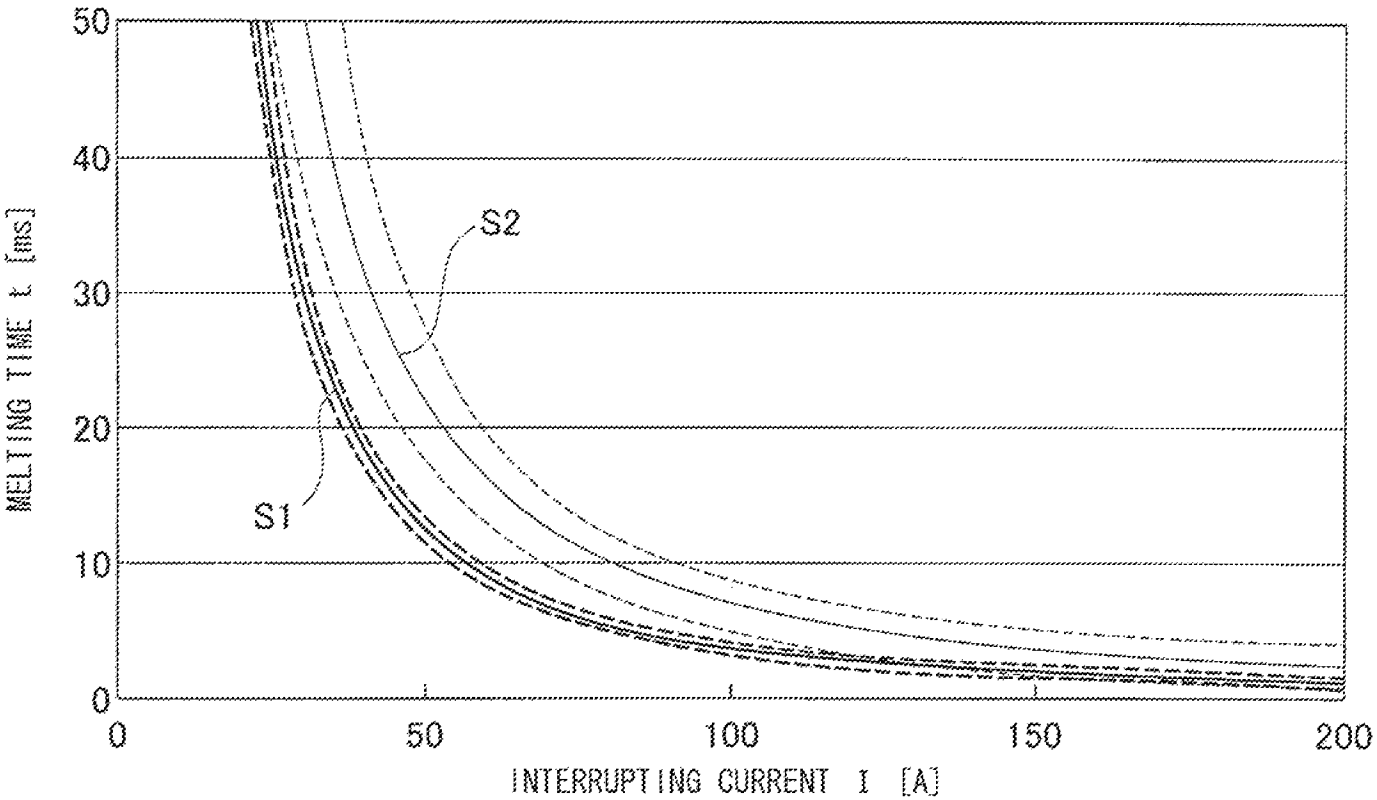
FIG. 11 is a graph showing a relationship between an interrupting current and a melting time of the test interrupt wire in each case where the test opening portion is defined and where test opening portion is not defined.

In FIG. 11, a bold solid line S1 shows a relationship between the interrupting current I and the melting time t of the test interrupt wire 101, a portion of which is exposed through the test opening portion 102, and a range between bold dashed lines centered on the bold solid line S1 shows a variation range of the melting time t with respect to the interrupting current I. A thin solid line S2 shows a relationship between the interrupting current I and the melting time t of the test interrupt wire 101 in a case where a test opening portion 102 is not defined, and a range between thin dashed lines centered on the thin solid line S2 shows a variation range of the melting time t with respect to the interrupting current I.

As shown in FIG. 11, at the same interrupting current, the melting time t decreases and the variation range decreases when the test opening portion 102 is defined by the solder resist layer. In contrast, in the case where the test opening portion 102 is not defined by the solder resist layer, the melting time t of the test interrupt wire 101 increases in each overcurrent range and the variation range increases compared with the case where the test opening portion 102 is defined.

This is because a melt conductor generated by melting of the test interrupt wire 101 flows from the test opening portion 102 and the melt conductor is less likely to stay at a position of the test interrupt wire 101 before melting.

Thus, when at least a portion of the interrupt wire 34 is exposed through the opening portion 28*a*, the melting time t decreases, the overcurrent protection action can be achieved early, and a temperature rise of a protected component can be restricted. Furthermore, a time for which a voltage of the power supply wire 23 decreases due to interruption by the interrupt wire 34 can be reduced. In addition, because the variation of the melting time t decreases, a capacity of a stabilizing capacitor that is designed in view of the melting time of the interrupt wire 34 in each device or each circuit can be reduced, and a cost and a size can be reduced. Furthermore, because the melting time t decreases also in a rated region of current, a circuit can be designed more freely.

As described above, when the interrupt wire 34 melts in accordance with heat generated by the overcurrent, a melt conductor generated by melting of the interrupt wire 34 flows from the opening portion 28*a*. Accordingly, the melt conductor is less likely to stay at a position of the interrupt wire 34 before melting, variations in the melt position and the melting time due to stay of the melt conductor can be restricted, and adverse effects to other electronic components 32 due to the heat generated by the interrupt wire 34 are restricted. Further, a decrease in an interrupt performance by the interrupt wire 34 can be restricted.

In the electronic control device 20*a* according to the present embodiment, the opening portion 28*a* is disposed so that the middle portion of the interrupt wire 34 which is most likely to melt is exposed outside. Alternatively, the opening portion 28*a* may be disposed so that another portion of the interrupt wire 34 is exposed outside or the whole interrupt wire 34 is exposed outside. The above-described configuration of the opening portion 28*a*, through which at least a portion of the interrupt wire 34 or 24 is exposed, may be applied to other embodiments and modifications.

(Third Embodiment)

An electronic control device 20*b* according to a third embodiment of the present disclosure will be described with reference to FIG. 12.

In the electronic control device 20*b*, the interrupt wire 34 is coupled with the power supply wire 23 via a connection wire 70.

Figure 12:
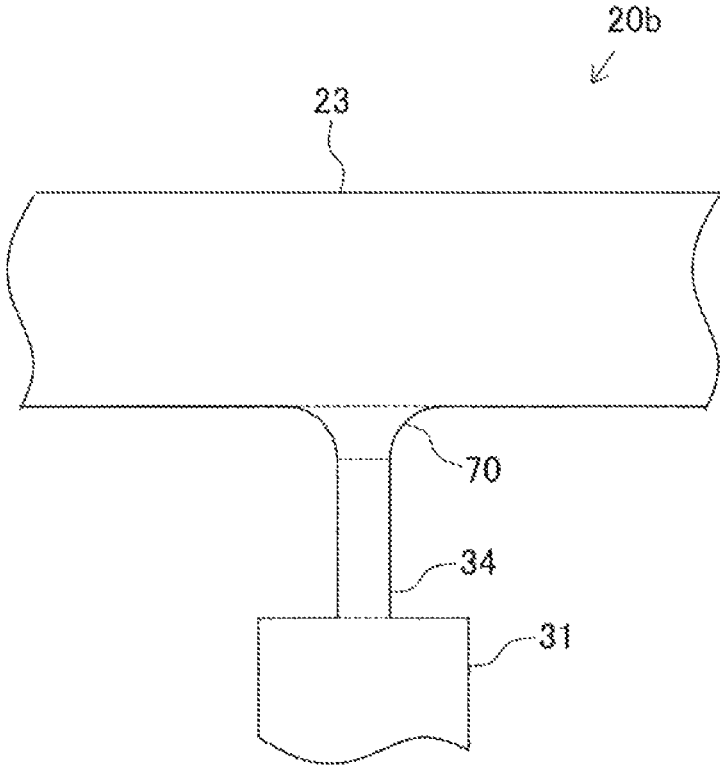
FIG. 12 is a diagram showing a part of an electronic control device according to a third embodiment of the present disclosure.

As shown in FIG. 12, an end of the interrupt wire 34 is electrically coupled with the power supply wire 23 via the connection wire 70. A wire width of the connection wire gradually increases toward the power supply wire 23 in an arc manner (R-shape) so that a cross-sectional area at an end of the connection wire 70 adjacent to the interrupt wire 34 is smaller than a cross-sectional area at the other end of the connection wire 70 adjacent to the power supply wire 23. Thus, side ends of the connection wire 70 smoothly connect with respective side ends of the interrupt wire 34 and gradually extend toward the power supply wire 23.

Thus, when heat generated at the interrupt wire 34 by an overcurrent is transmitted to the power supply wire 23 via the connection wire 70, heat required for melting the interrupt wire 34 is not absorbed excessively to the power supply wire 23 compared with a case where heat is transmitted directly to the power supply wire 23. Accordingly, a variation in temperature rise in the interrupt wire 34 can be restricted, and the decrease in interrupt performance of the interrupt wire 34 can be restricted. In particular, the heat generated at the interrupt wire 34 by the overcurrent is gradually diffused in the connection wire 70 and is widely transmitted to the power supply wire 23. Thus, a local temperature rise in the power supply wire 23 can be restricted. During a steady state of the electronic control device 20*b*, the interrupt wire generates heat due to the current flowing through the interrupt wire. In the steady state, overcurrent is not generated. Because the heat generated at the interrupt wire may be gradually diffused via the power supply wire 23 in the steady state, a temperature rise of the interrupt wire can be restricted and a long-term reliability of the electronic control device can be increased.

Because the side ends of the interrupt wire 34 and the respective side ends of the connection wire 70 are smoothly connected with each other, when the interrupt wire 34 and the connection wire 70 are formed using etching liquid, the etching liquid can uniformly flow at connecting portions of the side ends of the interrupt wire 34 and the respective side ends of the connection wire 70. Accordingly, the etching liquid is less likely to stay at the connecting portions and a variation in the wire width of the interrupt wire 34 can be restricted. Thus, the decrease in interrupt performance by the interrupt wire 34 can be restricted.

The connection wire 70 may be disposed between the interrupt wire 34 and the branch wire 31, or may also be disposed between the interrupt wire 24 and the power supply wire 23. The above-described configuration of the connection wire 70 may be applied to other embodiments and modifications.

While the present disclosure has been described with reference to preferred embodiments thereof, it is to be understood that the present disclosure is not limited to the above-described embodiments and constructions. The invention is intended to cover various modification and equivalent arrangements. In addition, while the various combinations and configurations, which are preferred, other combinations and configurations, including more, less or only a single element, are also within the spirit and scope of the present disclosure.

What is claimed is:

1. An electronic control device comprising:

one or more substrates;

a casing in which the one or more substrates are disposed;

a plurality of circuit blocks disposed on the one or more substrates;

a common wire shared by the plurality of circuit blocks;

a plurality of branch wires respectively coupled between the plurality of circuit blocks and the common wire; and two interrupt wires respectively coupled with two circuit blocks of the plurality of circuit blocks via two branch wires of the plurality of branch wires for overcurrent protection of the plurality of circuit blocks, wherein the two circuit blocks include one circuit block that performs a function having a lower importance and another circuit block that performs a function having a higher importance than the function having a lower importance performed by the one circuit block, the interrupt wire coupled with the one circuit block has a smaller interrupting current than an interrupting current of the other interrupt wire coupled with the another circuit block, the electronic control device is used in a vehicle control system of a vehicle, and the lower importance of the function performed by the one circuit block and the higher importance of the function performed by the another circuit block are predetermined according to which function is more critical to the vehicle's safety when the vehicle is traveling.

2. The electronic control device according to claim 1, wherein the two interrupt wires are disposed on one of the one or more substrates.

3. The electronic control device according to claim 1, further comprising a protective layer covering a surface of one of the one or more substrates including the two interrupt wires, wherein the protective layer defines an opening portion through which at least a portion of one of the two interrupt wires is exposed.

4. The electronic control device according to claim 1, further comprising a connection wire via which at least one of the two interrupt wires is electrically coupled with the common wire, wherein side ends of the connection wire are smoothly connected with respective side ends of the at least one of the two interrupt wires that is electrically coupled with the common wire, and the side ends gradually extend toward the common wire.

5. The electronic control device according to claim 1, wherein the common wire is a power supply wire.

6. A control system comprising:

a power supply path coupled with a power source;

a fuse disposed on the power supply path;

a device coupled with the power source by the power supply path via the fuse; and the electronic control device according to claim 5, wherein the power supply wire in the electronic control device is coupled with the power source by the power supply path via the fuse.

7. The electronic control device according to claim 1, wherein the function having the lower importance includes an engine control or a brake control, and the function having the lower importance includes an acceleration slip control or communication control of a vehicle mounted device.

8. An electronic control device comprising:

one or more substrates;

a casing in which the one or more substrates are disposed;

a plurality of circuit blocks disposed on the one or more substrates;

a common wire shared by the plurality of circuit blocks;

a plurality of branch wires respectively coupled between the plurality of circuit blocks and the common wire;

a first interrupt wire coupled with the common wire;

a second interrupt wire coupled with one circuit block of the plurality of circuit blocks via one branch wire of the plurality of branch wires for overcurrent protection of the one circuit block; and a third interrupt wire coupled with another circuit block of the plurality of circuit blocks via another branch wire of the plurality of branch wires for overcurrent protection of the another circuit block, wherein the one circuit block coupled with the second interrupt wire performs a function having a lower importance and the another circuit block coupled with the third interrupt wire performs a function having a higher importance than the function having the lower importance performed by the one circuit block, the second interrupt wire has a smaller interrupting current than an interrupting current of the third interrupt wire, the electronic control device is used in a vehicle control system of a vehicle, and the lower importance of the function performed by the one circuit block and the higher importance of the function performed by the another circuit block are predetermined according to which function is more critical to the vehicle's safety when the vehicle is traveling.

9. The electronic control device according to claim 8, wherein the first interrupt wire, the second interrupt wire, and the third interrupt wire are disposed on one of the one or more substrates.

10. The electronic control device according to claim 9, further comprising a protective layer covering a surface of the one of the one or more substrates on which the first interrupt wire, the second interrupt wire, and the third interrupt wire are disposed, wherein the protective layer defines an opening portion through which at least a portion of one of the first interrupt wire, the second interrupt wire, and the third interrupt wire is exposed.

11. The electronic control device according to claim 8, further comprising a connection wire via which at least one of the first interrupt wire, the second interrupt wire, and the third interrupt wire is electrically coupled with the common wire, wherein side ends of the connection wire are smoothly connected with respective side ends of the at least one of the first interrupt wire, the second interrupt wire, and the third interrupt wire that is electrically coupled with the common wire interrupt wire, and the side ends gradually extend toward the common wire.

12. The electronic control device according to claim 8, wherein the common wire is a power supply wire.

13. A control system comprising:

a power supply path coupled with a power source;

a fuse disposed on the power supply path;

a device coupled with the power source by the power supply path via the fuse; and the electronic control device according to claim 12, wherein the power supply wire in the electronic control device is coupled with the power source by the power supply path via the fuse.

14. The electronic control device according to claim 8, wherein the function having the higher importance includes an engine control or a brake control, and the function having the lower importance includes an acceleration slip control or a communication control of a vehicle mounted device.

15. The electronic control device according to claim 1, wherein the function performed by the one circuit block is one of a navigation device control, communication control of a vehicle mounted device, and an acceleration slip control, and the function performed by the another circuit block is one of a braking function and a steering function.

16. The electronic control device according to claim 8, wherein the function performed by the one circuit block is one of a navigation device control, communication control of a vehicle mounted device, and an acceleration slip control, and the function performed by the another circuit block is one of a braking function and a steering function.

17. The electronic control device according to claim 1, wherein the function having the higher importance is necessary for a normal traveling of the vehicle, and the function having the lower importance is unnecessary for the normal traveling of the vehicle.

18. The electronic control device according to claim 8, wherein the function having the higher importance is necessary for a normal traveling of the vehicle, and the function having the lower importance is unnecessary for the normal traveling of the vehicle.

19. An electronic control device comprising:

one or more substrates;

a casing in which the one or more substrates are disposed;

a plurality of circuit blocks disposed on the one or more substrates;

a common wire shared by the plurality of circuit blocks;

a plurality of branch wires respectively coupled between the plurality of circuit blocks and the common wire; and two interrupt wires respectively coupled with two circuit blocks of the plurality of circuit blocks via two branch wires of the plurality of branch wires for overcurrent protection of the plurality of circuit blocks, wherein the two circuit blocks include one circuit block that performs a function having a lower importance and another circuit block that performs a function having a higher importance than the function having a lower importance performed by the one circuit block, the interrupt wire coupled with the one circuit block has a smaller interrupting current than an interrupting current of the other interrupt wire coupled with the another circuit block, the electronic control device is used in a vehicle control system of a vehicle, the lower importance of the function performed by the one circuit block and the higher importance of the function performed by the another circuit block are predetermined according to which function is more critical to the vehicle's safety when the vehicle is traveling, the function having the higher importance is necessary for a normal traveling of the vehicle, and the function having the lower importance is unnecessary for the normal traveling of the vehicle.

* * * * *